US005908535A

United States Patent [19]

Fransson et al.

[11] Patent Number: 5,908,535

[45] Date of Patent: Jun. 1, 1999

[54] METHOD FOR DETERMINATION OF FILLER CONTENT IN PAPER

[75] Inventors: Per-Ivar Fransson, Åkersberga; Lars Granlöf, Täby; Mats Hagberg, Solna; Matts Jegebäck, Stockholm, all of Sweden

[73] Assignee: STFI, Stockholm, Sweden

[21] Appl. No.: 08/809,490

[22] PCT Filed: Sep. 25, 1995

[86] PCT No.: PCT/SE95/01091

§ 371 Date: Jun. 13, 1997

§ 102(e) Date: Jun. 13, 1997

[87] PCT Pub. No.: WO96/10738

PCT Pub. Date: Apr. 11, 1996

[30] Foreign Application Priority Data

Sep. 30, 1994 [SE] Sweden ..... 9403314

[51] Int. Cl.[6] ..... G01N 15/06; D21F 1/66; D21G 9/00

[52] U.S. Cl. ..... 162/198; 162/49; 162/190; 73/53.04; 73/863

[58] Field of Search ..... 162/198, 263, 162/DIG. 10, DIG. 11, 250, 49, 190; 73/53.03, 53.04, 863

[56] References Cited

U.S. PATENT DOCUMENTS

| | | | |
|---|---|---|---|
| 2,826,061 | 3/1958 | Forsten et al. | 73/53.03 |
| 3,035,967 | 5/1962 | Sacksen et al. . | |
| 4,110,044 | 8/1978 | Pettersson et al. | 356/103 |
| 4,210,490 | 7/1980 | Taylor . | |
| 4,409,853 | 10/1983 | Chase et al. | 73/863 |
| 4,689,988 | 9/1987 | Rydefalk et al. | 73/61 R |
| 4,698,832 | 10/1987 | Kuusi | 378/46 |
| 4,845,730 | 7/1989 | Mercer | 378/53 |
| 4,895,019 | 1/1990 | Lehmikangas et al. | 73/63 |
| 4,911,025 | 3/1990 | Söderling | 73/863 |
| 4,952,280 | 8/1990 | Hemel et al. . | |

FOREIGN PATENT DOCUMENTS

| | | |
|---|---|---|
| 0 5 41457 A1 | 5/1993 | European Pat. Off. . |
| 56-37543 | 4/1981 | Japan . |
| 57-33343 | 2/1982 | Japan . |
| 6-18449 | 1/1994 | Japan . |
| 7513524-4 | 5/1977 | Sweden . |
| 8400784-8 | 12/1985 | Sweden . |
| 8704485-5 | 8/1991 | Sweden . |
| WO 86/07458 | 12/1986 | WIPO . |
| WO 93/08925 | 5/1993 | WIPO . |

*Primary Examiner*—Stanley S. Silverman
*Assistant Examiner*—JoséS. Fortuna
*Attorney, Agent, or Firm*—Birch, Stewart, Kolasch & Birch, LLP

[57] ABSTRACT

A method of determining the filler content of paper, wherein the paper stock is examined prior to delivering the stock to the de-watering section of the paper machine, and wherein the volume concentration of particles in the stock that have a size which is greater than the characteristic size of the filler is determined at varying mechanical working of the pulp, and the amount of filler retained in the paper is predicted from the result of at least two such determinations.

8 Claims, 4 Drawing Sheets

METHOD FOR DETERMINATION OF FILLER CONTENT IN PAPER

BACKGROUND OF THE INVENTION

The present invention relates to a novel method of determining the filler content of finished paper.

The manufacture of paper involves the use of other ingredients in addition to fibers (paper pulp), for instance such ingredients as sizing agents, fillers, and possibly also pigments. Filler is used to impart special properties to the paper, particularly with regard to its printing characteristics, brightness and opacity. The filler is often cheaper than the paper pulp and is also used to lower the manufacturing costs. The most common fillers in this regard are white mineral substances, such as kaolin, chalk, talc and gypsum. Chalk is normally used in present-day manufacture. The filler is normally added in large quantities, particularly when manufacturing so-called fine paper. The paper may have a filler content of up to 50% ash content, although filler contents of about 20% are common.

Paper is manufactured on a paper machine from stock or stuff consisting of an aqueous solution of mainly fibers and additives, for instance filler. The stock, or stuff, normally contains about 0.5 percent by weight fibers. The stock is de-watered on a wire, to form a coherent paper web. The wire can be compared with a filter cloth which is essentially impermeable to fibers but permeable to the liquid and, e.g., to filler particles that fail to adhere to the fibers. Downstream of the so-called wire section the de-watered paper sheet will contain about 20 percent by weight fibers. The solution that passes through the wire is returned to incoming stock through the medium of a recycling circuit, normally referred to as the short circulation.

The filler particles are normally very small in size and chemicals which function to flocculate the filler and bind it to the fibers are added to the stock, to prevent the filler particles passing through the wire in the de-watering process. These chemicals are normally referred to as retention agents and include, e.g., polymer compounds that carry electric charges. Normally, about half of the filler is retained in the paper sheet and the remainder recycled. Only a relatively small amount of retention agent is added to the stock and it can be assumed that the retention agent remains generally in the paper, or looses its activity.

The term retention has been introduced as a measurement of how much of the material delivered to the paper machine fully remains in the finished paper. When the concentration of incoming material or one of its components, e.g. fibers or filler, in the incoming stock is $C_{in}$ and the flow is $F_{in}$, the weight of the dried paper per unit of time is P and the concentration in the recycled water is $C_{out}$, the retention R can be calculated as follows:

$$R = \frac{P}{C_{\text{in}} * F_{\text{in}}} \tag{1}$$

Since the recycled material constitutes the difference between the incoming quantity and the quantity of finished paper, the equation can be approximated to the following equation, since $F_{out} \approx F_{in}$:

$$R = \frac{C_{\text{in}} * F_{\text{in}} - C_{out} * F_{out}}{C_{\text{in}} * F_{\text{in}}} \approx 1 - \frac{C_{out}}{C_{\text{in}}} \tag{2}$$

Retention is used as a measurement of effectiveness in the de-watering process, and may also be applied as a parameter in controlling surface weight and filler content of the paper sheet.

Retention in the de-watering process can be assessed by on-line measuring of the consistencies of the incoming and outgoing flows. However, measuring of the consistency of the incoming and outgoing flows is encumbered with serious drawbacks, for instance such drawbacks as a disturbing influence of air bubbles, high stock temperatures and uneven consistency distribution in the filtrate, the white water. Sensitivity is also dependent on the measuring method used. One example of known methods applied to this end is the method taught by WO 86/07458, in which two optical measuring devices are used, of which one uses infrared light and the other uses polarized light. These signals are combined and then used to calculate the fiber/solids and filler contents of respective flows.

Another method involves measuring surface weight and ash content (filler content) of the dried sheet further on in the paper machine. This method employs the use, e.g., of traversing measuring instruments which move across the paper web. These instruments apply, e.g., X-ray fluorescence or X-ray absorption to determine the filler content. It is obvious that these known methods cause a delay in the control of stock consistency. Furthermore, when starting-up the paper machine, the paper web does not extend through the entire machine up to the point at which the measurements are taken.

Hitherto, retention has functioned solely as a diagnostic instrument in paper manufacturing processes. Furthermore, retention is not controlled essentially directly when practicing prior art methods. Normally, fibers and filler are metered to the stock in controlled quantities while awaiting equilibrium. Obviously, such indirect control involving addition of material to the large liquid volume constituted by the stock combined with the short circulation will also cause control delays.

There is therefore a need for a simple method by means of which retention can be predicted with a high degree of accuracy and with the smallest possible delay in the de-watering process, and also an associated method for controlling retention quickly and responsively and thereby a novel method for controlling the filler content of finished paper.

SUMMARY OF THE INVENTION

It has surprisingly been found that retention can be predicted easily and to a high degree of accuracy prior to manufacture of the paper, by applying a method according to the present invention.

Exhaustive tests with a known suspension preparation device (a so-called pulper or slusher) in accordance with Swedish Patent Publication 8704485-5 have shown that the stresses to which fibers and filler-flocs adhering thereto are subjected to in the de-watering process can be simulated by varying mechanical working of a stock sample with the aid of said device. It was also found that when the sample was worked more vigorously, the stock present in the device could be placed under such high stresses as to essentially free the fibers from adherent filler-flocs. It will be evident from this that in addition to measuring fiber consistency and filler concentration in accordance with known techniques (SE 8400784-7), the retention anticipated in the de-watering process can be calculated with the use of one single device, one single stock sample and one simple measuring process.

It will be understood, however, that the invention is not restricted to this particular device and that other devices suitable for mechanically working the sample may also be used. In its simplest form, the sample working device is a centrifugal pump or like device.

When practicing the inventive measuring method, the device used to mechanically work the sample is provided with an optical fiber consistency meter. The optical fiber consistency meter is a selective fiber consistency meter whose function is based on, e.g., the attenuation or scattering of radiation, e.g. visible light. The present invention provides a quick and reliable method of controlling the amount of filler in finished paper.

BRIEF DESCRIPTION OF THE DRAWING

The invention will now be described in more detail with reference to the accompanying drawings, in which

FIGS. 5*a* and 5*b*)

DESCRIPTION OF THE PREFERRED EMBODIMENTS

The inventive method is based on the known technique of measuring the volume of particles in the stock that in one dimension have an extension which exceeds a given length, e.g. 0.1 mm. These particles are referred to in the following as "long particles". The term long particles as used here includes fiber particles with or without adherent filler. The inventive method also includes a process of measuring the volume concentration of these long particles when working the sample under varying conditions and for placing the results obtained with at least two such measuring processes in relation to one another.

The measuring process is preferably based on the process described in Swedish Patent Publication 7513524-4. The measuring process is carried out at different flow conditions, wherein the particles are subjected to different forces (varying sample working conditions) that cause the filler to loosen from the fibers to differing extents depending on the extent of harshness with which the fibers are worked.

Figure 1A:
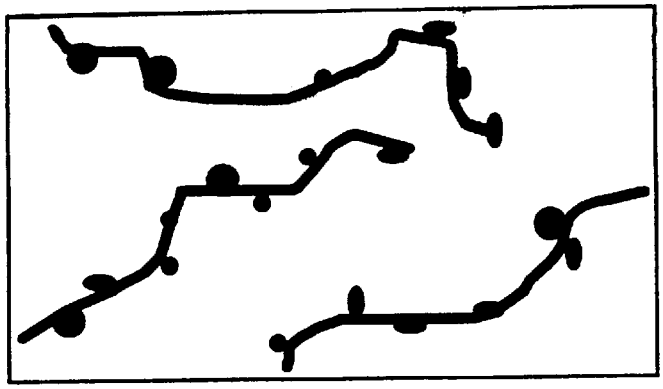
FIG. 1*a* is a schematic presentation which shows fibers with filler adhering thereto, for instance a stock sample which has been gently worked mechanically.
Figure 1B:
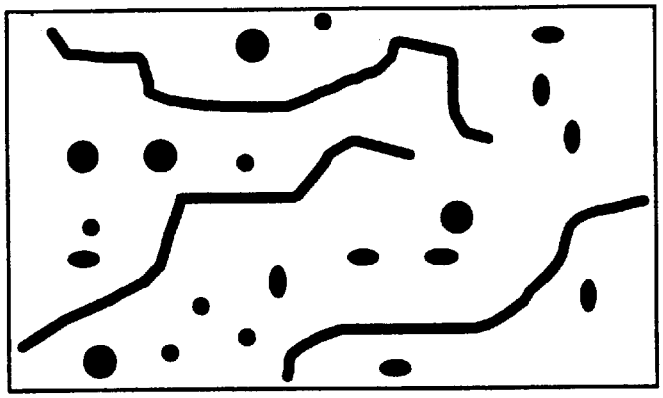
FIG. 1*b* is a schematic presentation which shows fibers that have been completely freed from adherent filler, for example a stock sample which has been vigorously worked.

In the case of weak forces, i.e. when the sample is worked under relatively gentle conditions, the long-particle volume will consist of the fiber volume together with the amount of filler that has been bound to the fibers by the action of the retention agent. See FIG. 1*a*. Thus, when the sample has been worked under gentle conditions, the consistency signal will have a higher value than when the sample has been worked under more vigorous conditions and the filler has been loosened from the fibers to a greater extent and when essentially only the fibers contribute to the particle volume. See FIG. 1*b*.

The measuring device used when practicing the inventive method may include a device according to SE 8704485-5 provided with an optical fiber meter, e.g. a device for emitting a delimited light beam and a detector, preferably in accordance with SE 7513524-4. The measuring process is based on measuring the volume of those particles in the liquid which in one dimension have an extension that exceeds a given length, e.g. a length of 0.1 mm. Particles of smaller dimensions are suppressed in the measuring signal.

Figure 2:
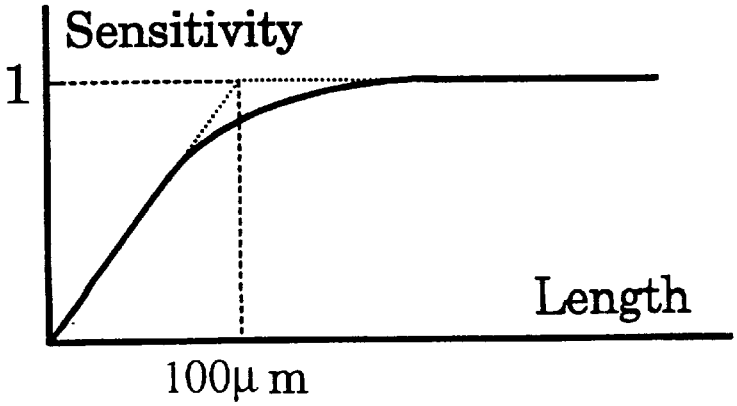
FIG. 2 shows the relationship between fiber length and measuring sensitivity of the fiber-consistency meter used.

By measuring the particle volume of a sample that has been worked vigorously enough, there is obtained a measurement of solely the fiber consistency, which is then used as a reference. Free filler will not influence the signal, since particles that have a dimension below 0.1 mm are suppressed. The response to fiber particles that is/are longer than 0.1 mm remains constant and the response to shorter particles diminishes with decreasing lengths. See FIG. 2. The threshold value, beneath which the sensitivity of the measuring process diminishes markedly, is here referred to as the break point. When practicing the inventive method, the break point is set to a value lying within the range of 0.1 to 5 mm, suitably at about 0.1 mm. However, the inventive measuring process is not restricted to these length dimensions and the choice of break point will depend on the type of fibers present and on the type of particle or types of particles that are to be suppressed. For instance, the particles to be suppressed may be flocculated filler particles that have not adhered to the fibers.

Figure 3:
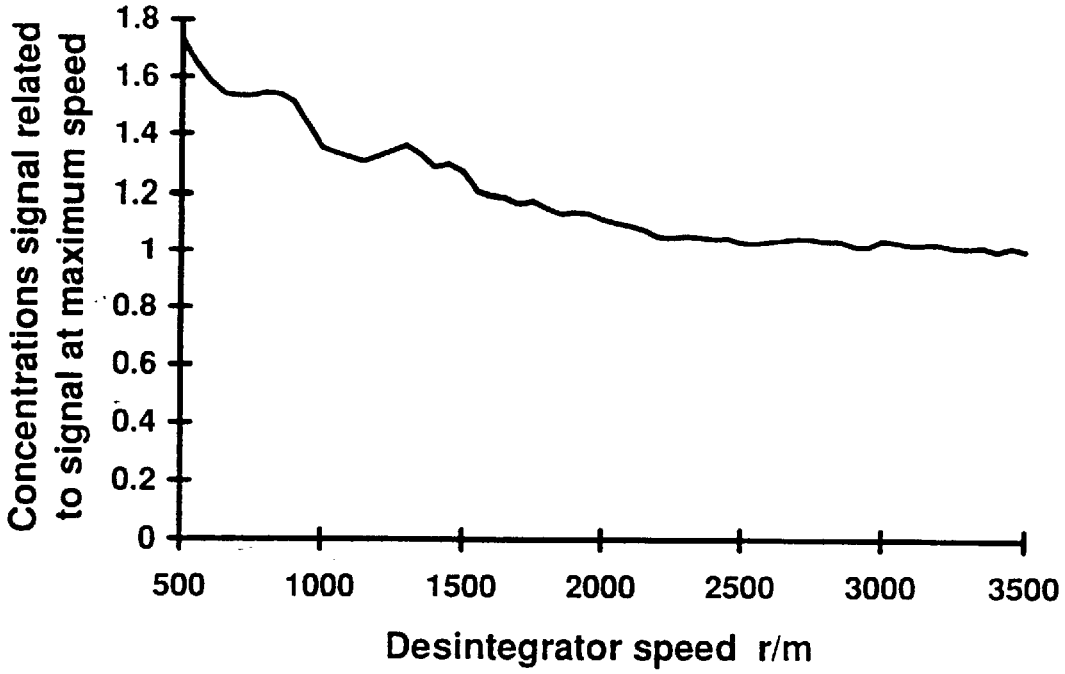
FIG. 3 illustrates an example of how the consistency signal from the measuring set-up varies with varying stresses (varying speeds)

It has been found that the consistency signal, i.e. a measurement of particle volume, varies with the vigorousness at which the stock sample is worked, for instance will vary with the rotational speed of the pulping device. FIG. 3 shows how the signal approaches a constant value when the stock is vigorously worked, for instance at high pulping speeds at which all filler flocs are disintegrated and any filler aggregates that remain will be smaller than 0.1 mm and therewith not contribute to the signal.

Figure 4:
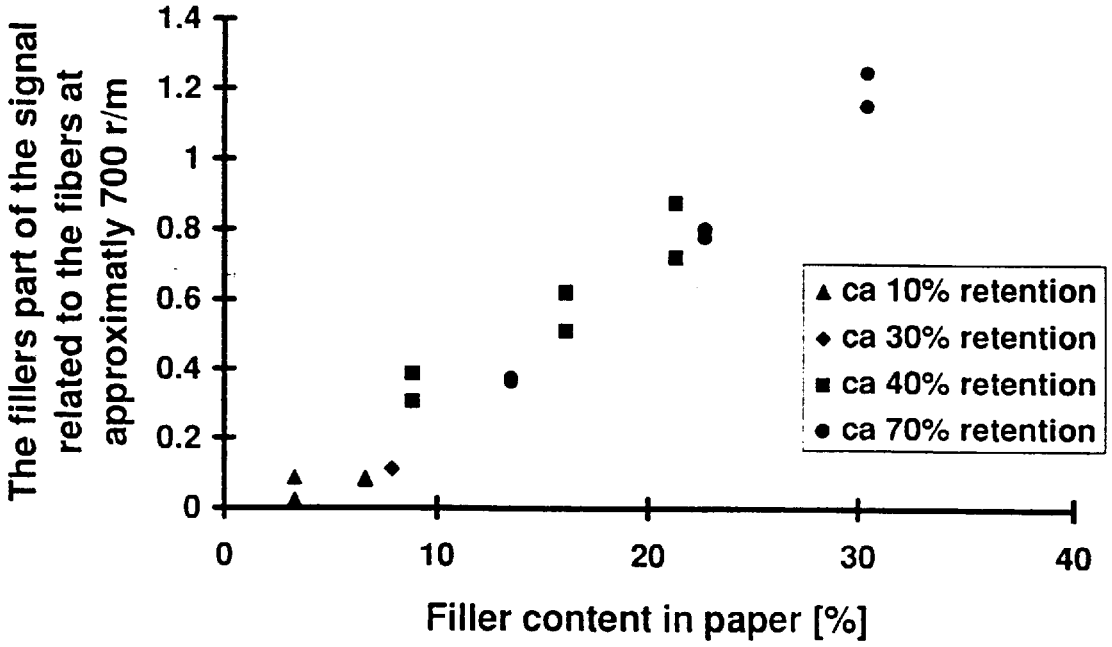
FIG. 4 illustrates the relative contribution of the filler to the consistency signal as a function of the filler content of the finished paper.

The forces to which the stock are subjected to in the de-watering process can be simulated by appropriate adjustment of the forces that are generated in the device in which the sample is worked mechanically, e.g. at a suitable speed in the device according to SE 8704485-5. It has been found that the contribution of filler to particle volume at appropriate rotational speeds has a linear relationship with the filler content of the paper. See FIG. 4. The amount of filler that will remain in the paper sheet after the de-watering process can be predicted on the basis of a measurement which is contingent on the strength with which the filler adheres to the fibers in the stock. When practicing the inventive method, retention can therefore be predicted by examining the stock prior to de-watering the same.

The filler content of the finished paper is conveniently controlled by firstly introducing retention agent to the stock, since small quantities of retention agent will quickly change the flocculating state of the stock and influence the de-watering process. Changes in the amount of filler added to the stock will also influence retention, although with a much greater delay. The filler concentration can also be calculated by supplementing the measuring equipment with a density measuring device, in accordance with a method described, e.g., in Swedish Patent Publication 8400784-7.

Figure 5A:
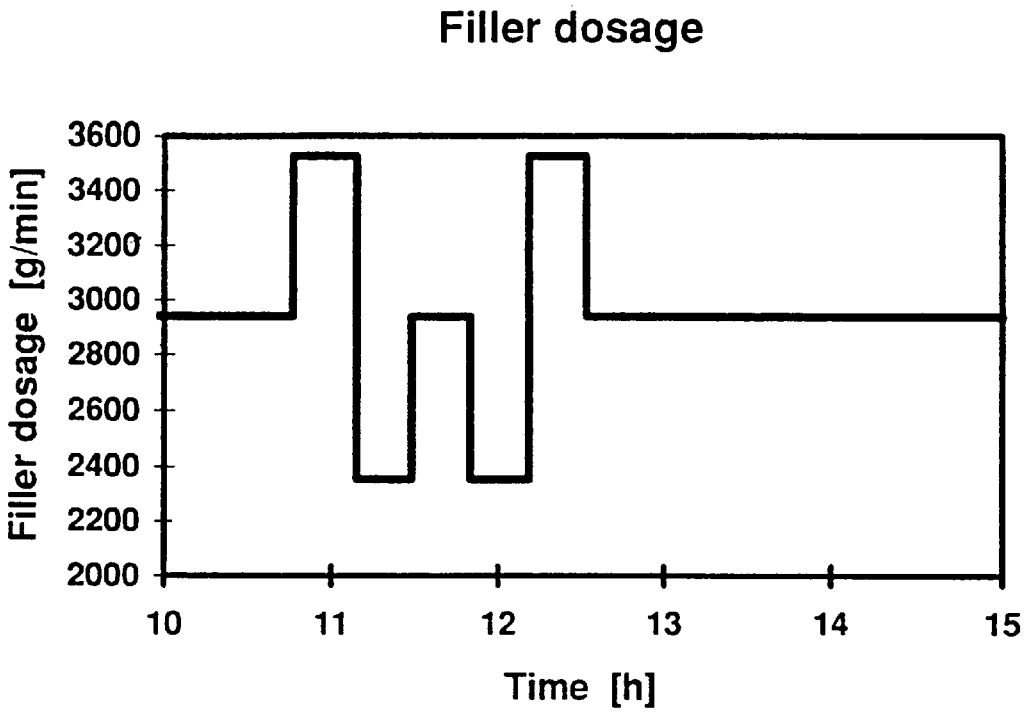
FIGS. 5*a* and 5*b* illustrate a test in which filler (5*a*) and retention agent (5*b*) were metered intermittently in varying quantities.
Figure 5B:
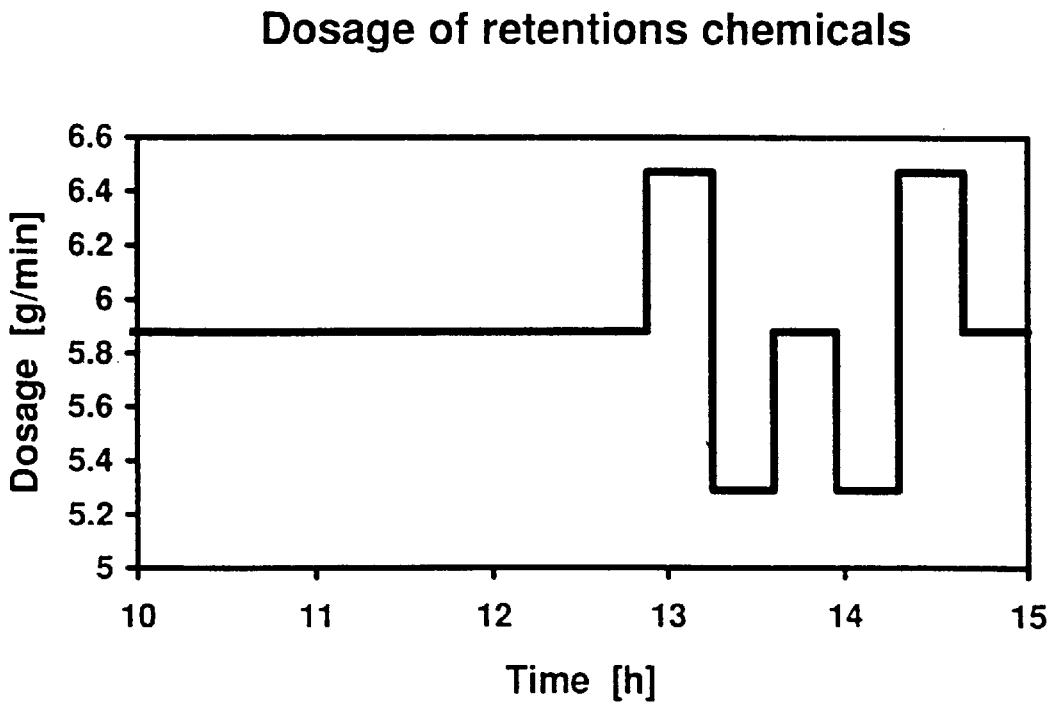
Figure 6:
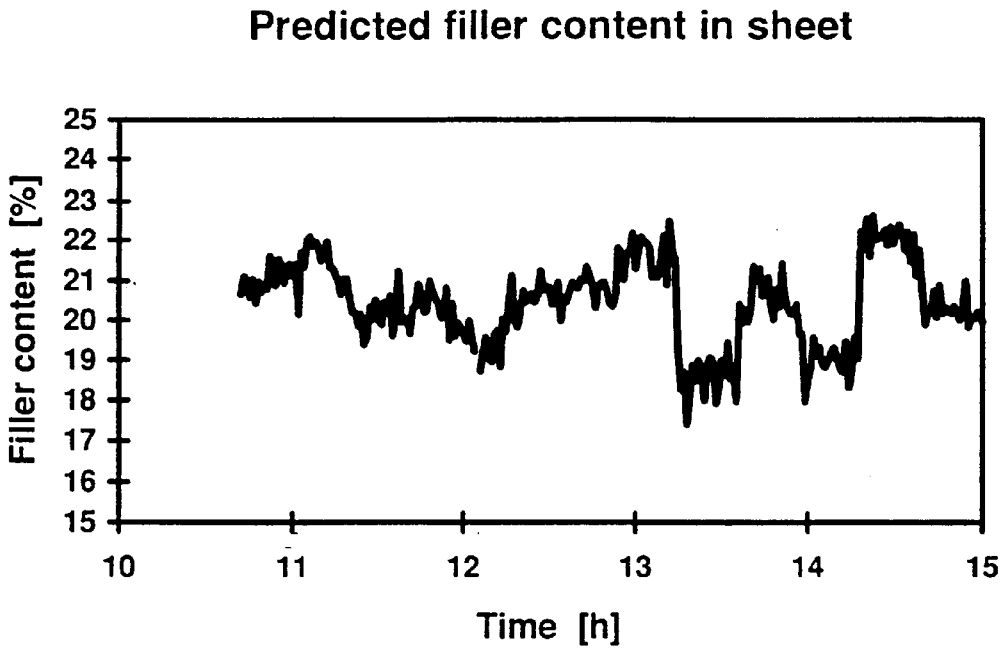
FIG. 6 illustrates the dependency of the predicted filler content of the paper sheet on the varying dosages of filler and retention agent respectively (c.f.

FIG. 5*a* shows how metering of filler to the stock was varied batch-wise in one embodiment, while keeping the amount of retention agent metered to the stock constant at the same time. FIG. 6 shows that the predicted filler content of the finished paper only slowly follows the varied filler addition. On the other hand, when the amount of filler metered to the stock was kept constant and the amount of retention agent was varied (FIG. 5*b*), this was immediately reflected in the predicted filler content of the paper sheet (FIG. 6). It is apparent from this that metering of the retention agent enables the filler content of finished paper to be controlled more rapidly.

Figure 7:
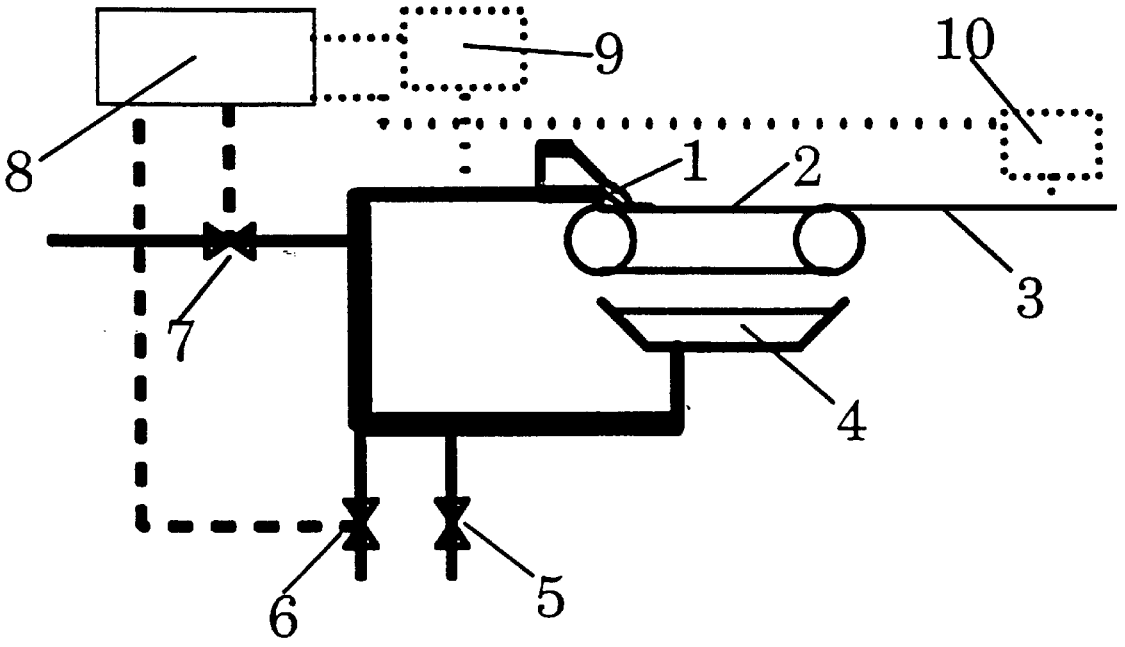
FIG. 7 is a schematic illustration of the wet part of a paper machine.

Paper is manufactured essentially in the following way (see FIG. 7): The stock in the head box (1) is pumped onto the wire (2) and the de-watered paper sheet continues along the paper path (3). Practically 100% of the fibers present and a part (e.g. about 10 to 90%) of the filler will accompany the sheet. The water and filler passing through the wire is collected and recycled (4). The infeed of fibers (5), filler (6) and suitably also retention agent (7) can be varied appropriately on the basis of the predicted filler-content of the finished paper (10), after measuring the stock in accordance with the invention (9) with the aid of a main control system (8).

The retention agent is introduced into the stock at the closest possible point adjacent the head box (1). The retention agent is conveniently introduced into the stock immediately upstream of or immediately downstream of an infeed pump, to ensure that the retention agent will be mixed adequately with the stock. The precise location at which the retention agent is introduced will depend on the properties of the retention agent and on the time taken for it to act, etc., and can be readily determined by the person skilled in this art. The stock sample used to examine the stock in accordance with the present invention will conveniently be taken at a location at which the distance from the point at which the retention agent was introduced to the measuring equipment is generally equally as long as the distance from the retention-agent introduction point to the head box, so as to ensure that the measuring result obtained when measuring a stock sample that has been worked to a lesser degree will correspond as far as possible to the condition in the head box.

The principle on which the inventive method is based is not contingent on the choice of retention agent. An appropriate retention agent can be readily determined by the person skilled in this art.

The novel method of determining more rapidly the amount of filler that accompanies the sheet enables new filler control strategies to be applied. When practicing known methods, retention agents are normally administered to the stock continuously and in fixed quantities, whereas the filler content of the paper sheet is controlled by introducing filler into the stock in metered quantities. This provides a highly stable although slow control of the filler content. Because of the rapid measuring process afforded by the inventive method, metering of the retention agent can be used to control the filler content of the paper. In general, the retention agent will act almost immediately on the ability of the filler to accompany the paper sheet. At the same time, the filler can be metered in quantities which will provide a buffer so as to maintain a suitable concentration of filler in the recycled solution.

Although the invention has been presented in a general form, it will be understood that changes and modifications can be made within the scope of the inventive concept. It will also be obvious to the person skilled in this art that the invention can also be applied to optimize the chemical system and/or in combination with conventional paper manufacture control processes.

We claim:

1. A method of determining a filler content of paper comprising the steps of:

examining paper stock prior to delivery to a de-watering section of a paper machine;

measuring a volume concentration of particles in the stock that have a size greater than the size of the filler while the paper stock is subjected to at least two degrees of mechanical working;

determining the amount of filler retained in the paper from a change in measured volume concentration between at least two such determinations of volume concentration.

2. The method according to claim 1, wherein said particles are fiber particles with or without filler adhering thereto.

3. The method according to claim 2, wherein one degree of mechanical working corresponds to a load to which the fibers are subjected in the manufacture of paper.

4. The method according to claim 2, wherein one degree of mechanical working corresponds to a load at which the fibers are freed substantially from adhering filler and filler agglomerates.

5. The method according to claim 1, further including the step of determining the filler concentration in water recycled from the de-watering process with the aid of the predicted filler content of the paper together with a measured filler concentration of an incoming flow of paper stock.

6. The method according to claim 1, further including the step of calculating a filler retention value on the basis of the determined filler content of the paper and a filler concentration measured in a head box of the paper machine.

7. The method according to claim 4, further including the step of directly controlling the filler content of de-watered paper by metering a retention agent and by controlling the filler concentration in a short circulation of the paper machine by introducing the filler in metered quantities.

8. The method according to claim 7, further including the step of adjusting the amount in which the retention agent is metered to the stock on the basis of the determined amount of filler and its relation to a desired filler content of the paper.

* * * * *